United States Patent [19]

Pryor

[11] Patent Number: 5,056,157

[45] Date of Patent: Oct. 15, 1991

[54] SOLAR RADIATION PROTECTING DEVICE AND METHOD

[76] Inventor: Linda D. Pryor, 5012 7th Ave., Los Angeles, Calif. 90043

[21] Appl. No.: 557,729

[22] Filed: Jul. 26, 1990

[51] Int. Cl.[5] ..... A41D 13/08

[52] U.S. Cl. ..... 2/16; 2/59

[58] Field of Search ..... 2/16, 22, 59, 61, 62, 2/126, 165, 275, 270, 271; 112/419

[56] References Cited

U.S. PATENT DOCUMENTS

| | | | |
|---|---|---|---|
| 569,471 | 10/1986 | Reily | 2/59 |
| 602,299 | 4/1898 | Blane | 2/62 |
| 731,791 | 6/1903 | Krifka | 2/16 |
| 794,294 | 7/1905 | Gardner | 2/59 |
| 925,952 | 6/1909 | Sacks | 2/59 |
| 946,541 | 1/1910 | Fletcher | 2/59 |
| 1,304,558 | 5/1919 | Grau | 2/16 |
| 1,351,378 | 8/1920 | Frankel | 2/59 |
| 1,360,840 | 11/1920 | White | 2/16 |
| 1,424,215 | 8/1922 | Rowe | 2/59 |
| 1,517,984 | 12/1924 | Harvey | 2/59 |
| 1,586,235 | 5/1926 | Billingsley | 2/62 |
| 1,796,782 | 3/1931 | Gasperini | 2/59 |
| 1,851,011 | 3/1932 | Jensen | 2/16 |
| 2,200,882 | 5/1940 | Goldsmith | 112/419 |
| 2,434,064 | 1/1948 | Bredin | 2/22 |
| 2,790,226 | 4/1957 | Feinberg | 2/271 |
| 2,904,792 | 9/1959 | Elliot | 2/16 |
| 4,190,902 | 3/1980 | Rhee | 2/16 |
| 4,665,562 | 5/1987 | Winer | 2/59 |
| 4,707,861 | 11/1987 | Lavoie et al. | 2/16 |
| 4,843,645 | 7/1989 | White | 2/59 |
| 4,856,112 | 8/1989 | Effle | 2/16 |
| 4,926,501 | 5/1990 | Goosen | 2/16 |
| 4,951,317 | 8/1990 | Gray et al. | 2/16 |
| 4,964,176 | 10/1990 | Previdi | 2/22 |

FOREIGN PATENT DOCUMENTS

| | | | |
|---|---|---|---|
| 2810991 | 9/1978 | Fed. Rep. of Germany | 112/419 |
| 451007 | 4/1913 | France | 2/59 |

*Primary Examiner*—Werner H. Schroeder
*Assistant Examiner*—Amy Brooke Vanatta
*Attorney, Agent, or Firm*—Robert S. Schaap

[57] ABSTRACT

A solar radiation protecting device for protecting the forearm and perhaps a portion of an upper arm of an individual when the arm of that individual projects outwardly of a vehicle window while the passenger or driver is seated within the vehicle. This protective device will protect against excessive solar radiation exposure when the arm is so projected beyond the window of the vehicle and thereupon exposed to solar radiation. The protecting device comprises a flexible fabric covering which extends over at least a portion of the forearm of the individual and also permits air exposure to the skin while worn. Strap means are located on the flexible fabric covering for releasably securing the fabric covering to the forearm of the individual.

13 Claims, 2 Drawing Sheets

SOLAR RADIATION PROTECTING DEVICE AND METHOD

BACKGROUND OF THE INVENTION

1. Field of the Invention

This invention relates in general to certain new and useful improvements in Solar Radiation Protecting Devices and Methods and more particularly, to a Solar Radiation Protecting Device and Method for protecting a forearm of an individual extending outwardly of a vehicle window from excessive solar radiation exposure.

2. Brief Description of the Prior Art

It is a very common practice for drivers of vehicles, such as drivers of passenger compartment vehicles, to project the forearm and perhaps even a portion of the upper arm extending outwardly beyond the window of a vehicle. If that portion of the arm which extends outwardly of the window is in direct exposure to the sun light for any substantial period of time, the vehicle driver will experience a sunburn to that portion of the arm projecting beyond the window of the vehicle. The same holds true of passengers who position their arms so that a portion of the forearm and perhaps position a portion of the upper arm projects outwardly of a vehicle window while resting the arm on the sill of the door or other portion of the vehicle.

There is no known device which is readily adaptable for extending over that portion of the arm to protect against excessive solar radiation exposure and which also permits airflow to provide a protective breathing of that portion of the skin of the arm projecting beyond the vehicle window. As a result, many drivers and passengers who position their arms so that a portion of the forearm and a portion of the upper arm extends beyond the vehicle window are relegated to the necessity of having to wear an article of clothing having long sleeves, such as a jacket or the like.

This creates the concomitant problem of forcing the driver and the passengers of the vehicle to store a jacket or other garment in the vehicle for the express purpose of wearing the same in the event the passenger or drive wishes to project his or her arm beyond the window of the vehicle.

There is clearly a need for a device which effectively reduces, if not entirely blocks, solar radiation exposure of a forearm of an individual projecting beyond a window of a vehicle and which also permits effective air flow for purposes of "breathing" of the skin of that forearm.

OBJECTS OF THE INVENTION

It is, therefore, one of the primary objects of the present invention to provide a Solar Radiation Protecting Device which is adapted to removably extend over a portion of the forearm and perhaps a portion of an upper arm of an individual who projects his or her arm beyond the window of a vehicle.

It is another object of the present invention to provide a solar radiation protecting device of the type stated which is light in weight and which also provides for effective air flow between the device and the skin of the forearm of an individual using same.

It is a further object of the present invention to provide a solar radiation protecting device of the type stated which is easily located on and over the forearm of an individual including a driver, even while the vehicle is moving.

It is an additional object of the present invention to provide a solar radiation protecting device of the type stated which can be constructed at a relatively low cost and which is highly effective in operation.

It is another salient object of the present invention to provide a method of protecting the forearm and perhaps a portion of an upper arm of an individual projecting beyond a window of a vehicle while the individual is seated within the vehicle by locating a device over the forearm of that individual which reduces or totally precludes solar radiation exposure to that portion of the forearm and upper arm of the individual.

With above and other objects in view, my invention resides in the novel features of form, construction, arrangement and combination of parts and components presently described and pointed out in the claims.

BRIEF SUMMARY OF THE DISCLOSURE

A device for protecting a forearm and perhaps a portion of an upper arm of an individual projecting outwardly of a vehicle window from excessive solar radiation exposure. The device in a preferred embodiment, comprises a protective flexible fabric covering which is adapted in size to extend over a forearm of an individual, an elbow and perhaps a portion of the upper arm projecting outwardly of a window of the vehicle when the individual is seated within the vehicle.

The protective fabric covering is adapted to extend around and generally conforms to a portion of the forearm of the individual to protect at least the forearm and the elbow and perhaps even a portion of the upper arm from excessive solar radiation when this portion of the arm is extended beyond the window of the vehicle. A strap means is located on the fabric for releasably securing the flexible fabric covering to the forearm of the individual. The strap means, comprised of individual straps, are adapted to enable the fabric to be worn on forearms of differing sizes and to conform to the size and shape of an individual's forearm.

In a more preferred embodiment of the invention, the fabric covering comprises a sheet of flexible, foldable material and a strap surrounds at least a portion of the arm and is secured to a surface of this fabric sheet. The strap is preferably secured to opposite surfaces of the fabric by lines of stitching which extend through the fabric and through both sides of the fabric as well as edges of the strap means. The strap means preferably comprises a plurality of spaced apart straps which are located along the length of the fabric covering. The straps, together with the fabric covering, are adapted to form an encircling structure to fit over and around the forearm of an individual using the solar radiation protecting device.

It is still another preferred embodiment of the invention the elongate straps enable conformance to the size and shape of the forearm of an individual. For this purpose, the straps may either be adjustable or they be formed of an elastic or other stretchable material.

Still in a preferred embodiment of the invention, the strap means comprises about three spaced apart straps and one of the straps is located in the region of the wrist of the individual when the device is worn. This last named strap has a size which is less than the size of the other straps on the solar radiation protecting device.

The solar radiation protecting device is preferably constructed so that a strip extends around the entire periphery or at least a substantial portion of the periphery of the fabric covering. This strip which is also formed of a fabric material, including a plastic material, is secured to the fabric sheet by a line of stitching which extends through the strip and the fabric sheet. The strip is preferably folded so that it extends over opposite sides of the fabric sheet along the periphery of the sheet and is secured by this line of stitching which extends through the fabric sheet and both sides of the strip.

In still another preferred embodiment of the invention, the strap means, such as the plurality of individual straps are secured to the solar radiation protecting device by the same line of stitching which is used for securing the peripheral strip around the periphery of the flexible fabric sheet. This fabric sheet has a size and shape which is adapted to fit over the forearm of a large number of individuals. Since the length of the forearm and for that matter even a portion of the upper arm does not change dramatically from individual to individual, the device is generally universally adapted for use with a large number of individuals.

The device is adapted to be worn so that it can be loosely fitted around the forearm but still can retain its position on the forearm of an individual. Thus, when the forearm is projecting beyond the window of the vehicle and the vehicle is moving, there is, in essence, a forced air flow between the arm and the fabric covering of the device.

The present invention also provides a method of protecting a forearm of an individual projecting outwardly from a vehicle window when the individual is seated within the vehicle from excessive solar radiation. The method comprises inserting a forearm in strap forming loops on a protective fabric covering so that the fabric covering is adapted to extend over and is retained on a portion of the forearm of the individual. In this case, the fabric sheet is adapted to conform to the overall size and shape of the forearm of the individual.

In this method, one end of the fabric covering is located in proximity to the wrist of the user of the device. The other end is located in proximity to or extends beyond the elbow of the individual using this device to thereby protect the portion of the arm extending beyond the window from exposure to excessive solar radiation.

The invention has other advantages and other purposes which will become more apparent from a consideration of the forms in which it may be embodied. One of these forms is described in the following detailed description of this invention and is more fully illustrated in the accompanying drawings. However, it is to be understood that this detailed description and drawings illustrate only one preferred form of the solar radiation protecting device and is not to be taken in a limiting sense.

BRIEF DESCRIPTION OF THE DRAWINGS

Figure 1:
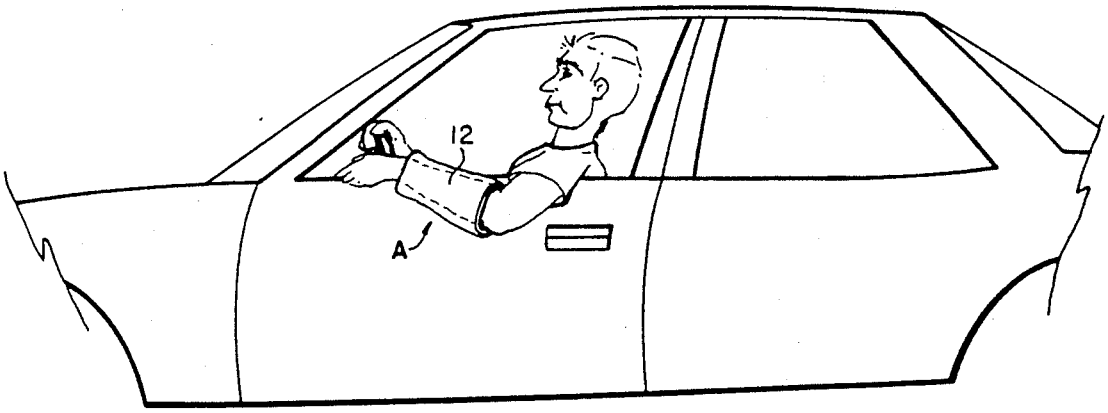
Figure 2:
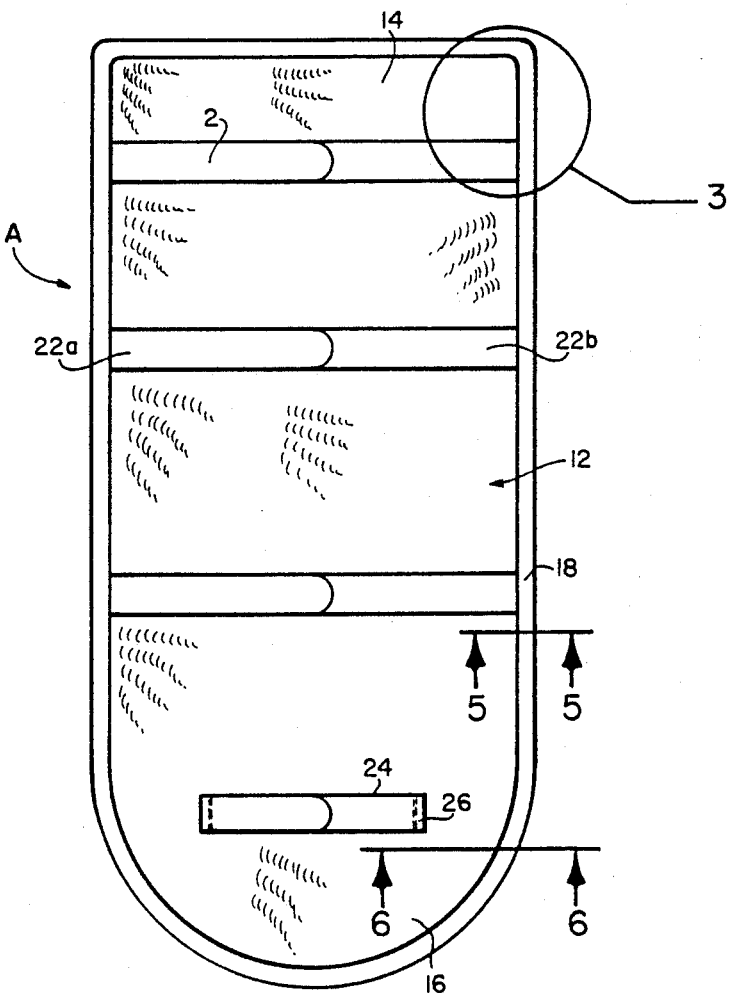
Figure 3:
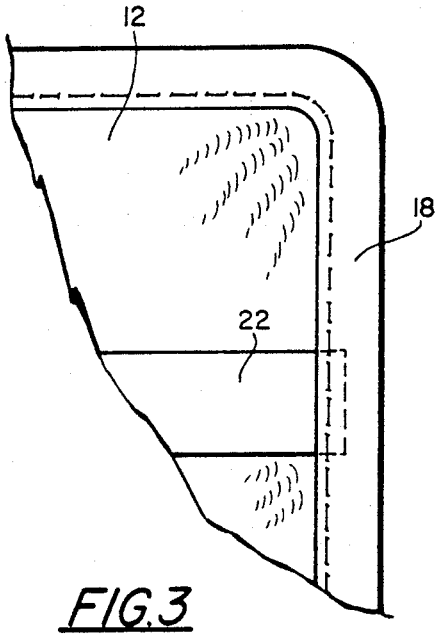
Figure 4:
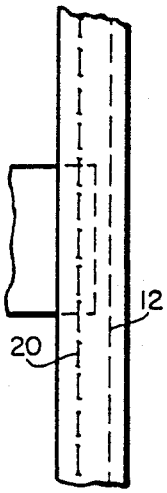
Figure 5:
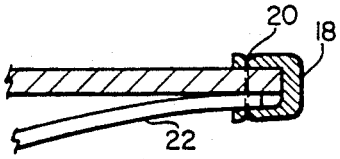
Figure 6:
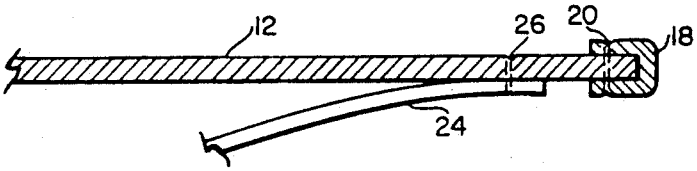
Figure 7:
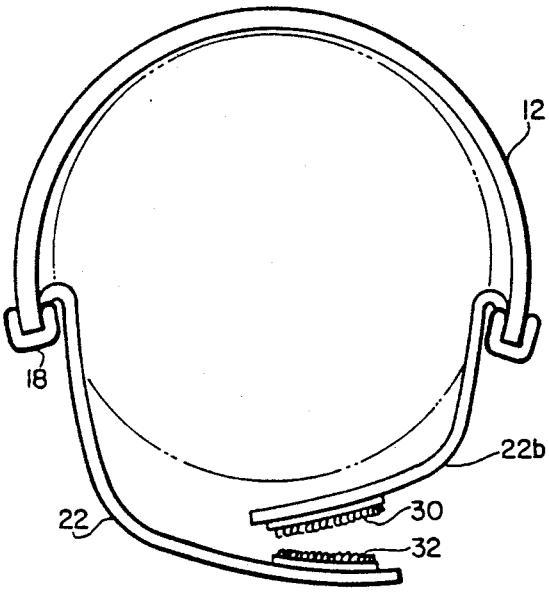

Having thus described the invention in general terms, reference will now be made to the accompanying drawings (two sheets) in which:

FIG. 1 is a side elevational view showing the use of a solar radiation protective device on the forearm and a small portion of the upper arm of an individual projecting beyond a window of a vehicle;

FIG. 2 is a plan view of the underside of the solar radiation protecting device of FIG. 1, that is the surface which faces the skin of the forearm of a user;

FIG. 3 is an enlarged elevational view showing a portion of the solar radiation protecting device included within the circle designated as 3 in FIG. 2;

FIG. 4 is an enlarged sectional view showing the securing of straps to a fabric covering forming part of the solar radiation protective device of the present invention;

FIG. 5 is a fragmentary sectional view of the protective device taken substantially along the plane of line 5—5 of FIG. 2;

FIG. 6 is a fragmentary sectional view of the device taken substantially along line 6—6 of FIG. 2; and FIG. 7 is an end elevational view of the solar radiation protective device adapted to encircle about a portion of the forearm of an individual using same.

DETAILED DESCRIPTION OF A PREFERRED EMBODIMENT

Referring now in more detail and by reference characters to the drawings which illustrate a preferred embodiment of the present invention, "A" designates a solar radiation protective device for extending around the portion of an arm of an individual projecting beyond the open window of a vehicle when an individual is seated within the vehicle. The actual use of the solar radiation protective device is more fully apparent from a brief examination of FIG. 1 wherein an individual is seated within a vehicle and which shows the position of the driver of the vehicle. The forearm of this individual is projected beyond the open window of the vehicle while the driver is seated. In this position, it can be observed that without the protective device "A", that portion of the forearm of the individual would be exposed to solar radiation and which could become excessive exposure if the arm remains in that position for any substantial period of time.

In the embodiment of the invention as illustrated in FIG. 1, it can be observed that the solar radiation protective device "A" extends from approximately the wrist of the individual to approximately the elbow of the individual. It should be understood that this device could actually extend over the elbow of the individual if desired. Furthermore, it could actually extend over a portion of the upper arm of the individual. However, it can be observed that there is no substantial portion of the upper arm projecting beyond the window of the vehicle. Therefore, the opposite end of the protective device may terminate in proximity to the region of the elbow of the user.

The solar radiation protective device "A" of the present invention comprises a fabric sheet 12 and having one straight end 4 and an opposite arcuately shaped end 16, in the manner as best illustrated in FIG. 2 of the drawings. The fabric sheet should be flexible and foldable so that it can be easily fitted upon and adapted to the contour and shape of the arm of a user.

The fabric sheet may be formed of essentially an foldable or flexible fabric material, as for example, cloth materials. The term "fabric" is used in a broad sense to encompass and include plastic sheets which are foldable and flexible. Furthermore, plasticize cloth materials are also encompassed by the fabric sheet of the present invention. The fabric sheet may adopt any material even including a paperboard material, if desired, so that the device itself could be of a disposable nature.

Extending around the fabric sheet 12 is a protective rim forming strip 18. In this case, the strip 18 is folded over so that it has portions extending over and engaging opposite surfaces of the fabric sheet 12, as best illustrated in FIG. 5 of the drawings. Further, the rim forming strip 18 may be secured to the fabric sheet 12 by means of a line of stitching 20 which extends completely through the fabric sheet 12 as well as both of the pieces of the rim forming strip 18 on opposite sides of the fabric sheet 12.

The solar radiation protecting device "A" of the present invention also includes a plurality of retaining straps and, in the embodiment as illustrated, includes three pairs of retaining straps 22 which extend between opposite longitudinal sides of the fabric sheet. The embodiment of the device "A" also includes an additional retaining strap 24 which has a length less than that of the other three straps 22, as best illustrated in the FIG. 2 of the drawings. The strap 24 is secured directly to the fabric sheet 12 by means of lines of stitching, 26 as best illustrated in FIGS. 2 and 6 of the drawings. However, by further reference to FIGS. 2 and 5 of the drawings, it can be observed that the three sets of fabric strips 22 extend essentially to the edges of the fabric strip 12 and are covered by the rim forming strip 18.

Using the line of stitching 20 for securing the rim forming strip 18 to the fabric and also for securing the edges of the straps 22 to the fabric sheet reduces the number of work operations required and thereby simplifies the construction producing an overall less expensive device. Each of the straps 22 and straps 24 are comprised of strap sections, as for example, a strap section **22*a* and a strap section 22*b*. These strap sections are provided for releasable attachment to one another. Thus, on its exteriorly presented surface, the strap 22*b* could be provided with an attachment section as for example, a fiber fastening strip. In like manner, on its interiorly presented surface, the strap 22*a* could be provided with a mating fiber fastening strip so that the two strap sections are releasably attachable to one another. The same holds true with regard to all of the straps 22 and also for the strap 24**.

It should be understood in accordance with the present invention that the straps could be formed of an elastic material so that the arm of the user could be introduced into loops formed by the individual straps.

In the embodiment of the invention as illustrated in FIG. 7, it can be observed that the strap **22*b* is provided with a Velcro type fiber fastening strip 30. In like manner, the strap 22*a* is provided on its interiorly presented surface with a Velcro fiber fastening strip 32. Thus, when the two fiber fastening strips 30 and 32** are releasably secured together, they will form a complete loop. It should be understood that adhesive attachment strips and the like could also be used in place of the fiber fastening strips.

The device of the present invention and the method utilizing this device have been found to be highly effective in reducing solar radiation exposure to the forearm and perhaps even portions of an upper arm of an individual who projects his or her arm beyond the window of a vehicle and rests his or her arm on the sill of the door or other portion of the vehicle. The device is light in weight and easily transportable and moreover easy to apply to a user. While it is recognized that athletes in various sporting events, as for example, in the game of hockey have utilized protective arm pads, they are generally bulky, heavy as a result of substantial padding and do not permit adequate air flow. Therefore, the device of the present invention presents a substantial improvement over anything in the prior art, particularly for reducing excessive solar radiation exposure to a forearm of an individual.

Thus, there has been illustrated and described a unique and novel solar radiation protective device and a method therefore which precludes excessive solar radiation exposure to the forearm of an individual projected beyond the window of the vehicle while the individual is seated within the vehicle. This invention therefore fulfills all of the objects and advantages which have been sought. It should be understood that many changes, modifications, variations and other uses and applications will become apparent to those skilled in the art after considering this specification and the accompanying drawings. Therefore, any and all such changes, modifications, variations, and other uses and applications which do not depart from the spirit and scope of the invention are deemed to be covered by the invention.

Having thus described the invention, what I desire to claim and secure by letters patent is:

1. A device for protecting a bare forearm including the upper exposed portion of that forearm and a bare portion of an upper arm of an individual projecting outwardly of a vehicle window from solar radiation exposure, said device comprising:

a) a protective flexible fabric covering which is sized to extend at least over a portion of a circumference of a forearm of an individual and when worn to have one end located to extend over and beyond the elbow of the individual's forearm, said covering having an opposite end which is located in proximity to the wrist of the individual when worn by the individual, said fabric covering extending around and generally conforming to but loosely fitting around a portion of a circumference of the forearm and lower portion of an upper arm of the individual to protect the forearm including the upper exposed portion of that forearm and a lower portion of the upper arm from solar radiation exposure when the forearm projects outwardly of and beyond the window of the vehicle, said fabric covering being formed of a cloth material which will block solar radiation but allows substantial air flow through the device and which also permits relatively unrestricted movement of the arm of an individual when worn without impeding any driving activity of the individual, and b) strap means on one side of said fabric for releasably securing the fabric covering to the forearm and a bare portion of the upper arm of the individual, said strap means being adapted to enable the device to be worn on forearms and bare portions of the upper arms of differing sizes and to conform to the sizes and shapes thereof.

2. The device for protecting the bare forearm including the upper exposed portion of that forearm and a bare portion of an upper arm of an individual of claim 1 further characterized in that said fabric covering comprises a sheet of flexible and foldable material and a strip surrounding at least a portion of the sheet and being secured to opposite surfaces of the fabric sheet.

3. The device for protecting the forearm including the upper exposed portion of that forearm and a bare portion of an upper arm of an individual of claim 2 further characterized in that said strip is secured to the opposite surfaces of the fabric by a line of stitching which extends through the fabric and both sides of the strip on both sides of the fabric sheet.

4. The device for protecting the forearm including the upper exposed portion of that forearm and a bare portion of an upper arm of an individual of claim 1 further characterized in that said strap means comprises a plurality of spaced apart straps which together with the fabric covering are adapted to form an encircling structure to fit over and around the forearm and a bare portion of the upper arm including an upper exposed portion of that forearm of the individual using the device.

5. The device for protecting the forearm including the upper exposed portion of that forearm and a bare portion of an upper arm of an individual of claim 4 further characterized in that said straps are elastic straps enabling conformance to the size and shape of the forearm and bare portion of the upper arm of the individual.

6. The device for protecting the forearm including the upper exposed portion of that forearm and a bare portion of an upper arm of an individual of claim 4 further characterized in that said strap means comprises at least three straps and one of the straps is located in the region of a wrist of an individual user and this last named strap located in the region of the wrist is smaller in size than the other of the straps.

7. The device for protecting the forearm including the upper exposed portion of that forearm and a bare portion of an upper arm of an individual of claim 1 further characterized in that said fabric covering comprises a sheet of flexible and foldable fabric material and a strip surrounds at least a portion of the fabric material sheet and being secured to opposite surfaces of the sheet by a single line of stitching which extends through the fabric sheet and both sides of the strip on both sides of the fabric sheet, and that said strap means comprises a plurality of straps which together with the fabric sheet form an encircling structure to fit over and around the forearm of the individual using same, and which straps are secured to said fabric sheet by the same line of stitching used for securing the strip to the fabric sheet.

8. A method for protecting a forearm including the upper exposed portion of that forearm and a bare portion of an upper arm of an individual projecting outwardly of a vehicle window from solar radiation exposure, said method comprising:

a) locating a forearm of an individual in strap-forming loops on a protective flexible fabric covering so that the protective fabric covering is retained on and around a circumference of a forearm including that upper exposed portion of the forearm and a bare portion of an upper arm of an individual using the device, said strap-forming loops when encircling about the forearm being adapted to conform to the size and shape of the forearm and bare portion of the upper arm of the individual using the device and having an end located in proximity to the wrist of a user when worn, said fabric covering being formed of a cloth material which will block solar radiation but allows substantial air flow through the device and which also permits relatively unrestricted movement of the arm of an individual when worn without impeding any driving activity of the individual, and b) locating the protective flexible fabric covering to extend over and around a portion of a circumference of the forearm and a portion of a bare upper arm including the upper exposed portion of that forearm of the individual so that one end is located in proximity to or extending over and beyond the elbow of an individual user and so that the other end is located in proximity to the wrist of the individual user when the device is worn by an individual, to thereby protect the forearm including the upper exposed portion of that forearm and a bare portion of an upper arm of the individual from solar radiation exposure when the user of the device projects his or her arm outwardly of an beyond the window of the vehicle.

9. The method of claim 8 further characterized in that said method comprises wearing the protective device when the forearm of the individual using same projects beyond and outwardly of the window of an automotive vehicle.

10. The method of claim 9 further characterized in that said method comprises wearing the protective device when the forearm of the individual using same projects beyond and outwardly of the window of a passenger compartment of an automotive vehicle.

11. A device for protecting a bare forearm including the upper exposed portion of that forearm and a bare portion of an upper arm of an individual projecting outwardly of a vehicle window from solar radiation exposure, said device comprising:

a) a protective flexible fabric covering comprised of a sheet of flexible and foldable material which is sized to extend at least over a portion of a circumference of a forearm including the upper exposed portion of that forearm of an individual and when worn to have one end located to extend over and beyond the elbow of the individual's forearm, said covering having an opposite end which is located in proximity to the wrist of the individual when worn by the individual, said fabric covering extending around and generally conforming to but loosely fitting around a portion of the forearm including the upper exposed portion of that forearm and lower portion of an upper arm of the individual to protect the forearm including the upper exposed portion of that forearm and a lower portion of the upper arm from solar radiation exposure when the forearm projects outwardly of and beyond the window of the vehicle, said fabric covering being formed of a cloth material which will block solar radiation but allows substantial air flow through the device and which also permits relatively unrestricted movement of the arm of an individual when worn without impeding any driving activity of the individual, b) a plurality of spaced apart elastic straps on one side of said fabric and which form an encircling structure for releasably securing the fabric covering to the forearm and a bare portion of the upper arm of the individual, said straps being adapted to enable the device to be worn on forearms and bare portions of upper arms of differing sizes and to conform to the sizes and shapes thereof, certain of said straps extending toward and terminating in proximity to the outer edges of the fabric, c) a protective strip surround the sheet of material at an outer peripheral edge thereof, said strip extending over and covering outer end portions of said certain of the straps, and d) a line of stitching extending through the fabric sheet and both sides of the strip on both sides of the fabric sheet, and which line of stitching also secures the end portions of said certain of the straps to said fabric sheet.

12. The device of claim 11 further characterized in that said straps each comprises a pair of strap sections with each one of said sections on an opposite edge of said covering and being capable of releasably securing to one another.

13. The device of claim 4 further characterized in that said covering is elongate and sized to extend over a greater portion of the length of a user's forearm, and the width is only sufficient to extend around a portion of the circumference of the forearm of the user.

* * * * *